US005713299A

United States Patent [19]

Lopez Ibor Aliño et al.

[11] Patent Number: 5,713,299

[45] Date of Patent: Feb. 3, 1998

[54] SUBMERSIBLE BOAT

[76] Inventors: Jose Lopez Ibor Aliño; Mariano Perez Sobrino; Javier Roy Couto, all of Parque Industrial Europolis, Calle Berna 13 (Calle M), 28230 Las Rozas (Madrid), Spain

[21] Appl. No.: 605,129

[22] PCT Filed: Jul. 5, 1995

[86] PCT No.: PCT/EP95/00084

§ 371 Date: Apr. 16, 1996

§ 102(e) Date: Apr. 16, 1996

[87] PCT Pub. No.: WO96/01207

PCT Pub. Date: Jan. 18, 1996

[30] Foreign Application Priority Data

Jul. 5, 1994 [ES] Spain ..... 9401454

[51] Int. Cl.[6] ..... B63G 8/00

[52] U.S. Cl. ..... 114/331; 114/333; 114/338

[58] Field of Search ..... 114/312, 313, 114/321, 322, 326, 330, 331, 332, 333, 334, 337, 338, 121, 123, 124, 125, 183 R, 274

[56] References Cited

U.S. PATENT DOCUMENTS

| | | | |
|---|---|---|---|
| 3,257,982 | 6/1966 | Meldrum | 114/16 |
| 3,388,683 | 6/1968 | Barhite et al. | 114/333 |
| 3,716,009 | 2/1973 | Strickland | 114/16 E |
| 3,897,744 | 8/1975 | Lang | 114/61 |
| 4,055,138 | 10/1977 | Klein | 114/244 |
| 4,411,213 | 10/1983 | Laukien | 114/312 |
| 4,615,292 | 10/1986 | Laukien | 114/312 |
| 4,805,549 | 2/1989 | Svenning et al. | 114/325 |
| 4,841,896 | 6/1989 | Fury | 114/312 |
| 5,058,521 | 10/1991 | Payne, III | 114/339 |
| 5,144,905 | 9/1992 | Tanaka | 114/312 |

FOREIGN PATENT DOCUMENTS

| | | |
|---|---|---|
| 2598674 | 11/1987 | France . |
| 3342913 | 6/1985 | Germany . |
| 8609108 | 12/1986 | Spain . |
| 2011310 | 1/1990 | Spain . |
| 1165970 | 10/1969 | United Kingdom . |
| 1524938 | 9/1978 | United Kingdom . |
| 2006127 | 5/1979 | United Kingdom . |
| 2060504 | 10/1983 | United Kingdom . |

OTHER PUBLICATIONS

Gabler, Ulrich "Construccion De Submarinos", 1982, Ed. S. Martin. Madrid–España, pp. 65–77, 87–93, 100.

A Group of Authorities, "Marine Eng.", 1971, Ed. Sname; New York, p. 698.

*Primary Examiner*—Stephen Avila

*Attorney, Agent, or Firm*—Ladas & Parry

[57] ABSTRACT

Submersible boat is capable of navigating both on the water surface and submerged, the diving taking place by dynamic effect when the operator requires it, the boat having a catamaran type structure, comprising two side floats which are maintained partially under the water-line while its cabin is kept totally above the water-line when the boat navigates at the water surface. Fins situated between the floats provide for the steerability of the boat, both submerged and at the water surface, while the thrust is generated by a pair of propellers situated at the lower end of the floats and actuated by diesel engines when the boat navigates on top of the water or is submerged in shallow waters, but in deep waters the engines are substituted by electric motors run by batteries.

14 Claims, 10 Drawing Sheets

SUBMERSIBLE BOAT

OBJECT OF THE INVENTION

The present invention relates to a submersible boat, in other words an aquatic vehicle capable of navigating both on the water surface and submerged and therefore, in addition to offering a performance similar to that of a conventional submarine, when used as a surface boat, its cabin for occupants lies entirely above the water as a classic boat.

BACKGROUND OF THE INVENTION

The very applicants hold a U.S. Pat. No. 8,703,322 disclosing a two-level mobile land-sea crawler capable of travelling on both dry land and in water, and when in water both on the surface and submerged, a fundamental characteristic in the latter respect being that diving was achieved dynamically with the assistance of fins which were suitably directed to force the mobile vehicle to dive due to its forward speed.

Whilst perfectly valid from a theoretical viewpoint, the solution used was in practice inconvenient in a number of ways, as follows:

The fact that the mobile vehicle is capable of diving only dynamically prevents the body from remaining static underwater, which could often be interesting or necessary.

The dynamic diving effect as such means that the diving effort required is substantial and that the energy consumed in so diving is therefore also substantial.

The very presence of the fins used to steer the mobile vehicle, projecting sideways from the same, poses difficulties.

Lastly, having been conceived as a vehicle capable of travelling on dry land, the mobile vehicle has a number of structural and design limitations that are far more significant than the scarce advantages derived from such possibility, for use of the mobile vehicle to travel on land is expected to be rare, almost negligible, as compared with its use in water.

SUMMARY OF THE INVENTION

Bearing in mind the above, the submersible boat subject of the present invention has been deprived of the possibility of travelling on land which has concurrently considerably enhanced its performance over that of the mobile vehicle subject of U.S. Pat. No. 8,703,322.

More specifically, in order to achieve the above, and in accordance with one of the characteristics of the invention, the submersible boat is structured as a submersible catamaran and therefore when it navigates as a surface boat, the cabin for occupants lies entirely above water, as on a conventional catamaran, and unlike conventional submarines where the cabin for occupants is submerged at all times, even when it does not navigate underwater.

In accordance with another characteristic of the invention, the two side floats of the boat which support the cabin aforesaid not only serve such purpose and house certain of the boat's accessories, as described further on, but carry a number of ballast tanks serving a twofold purpose, namely on the one hand approximating the boat's buoyancy rate to almost zero at the time of diving and thereby expediting this operation, in other words enabling diving to be quicker and dynamic, and on the other hand suitably increasing the ballast after the dive in order that the boat may stop its forward travel and remain stable at the selected depth.

In accordance with another characteristic of the invention, the boat steering fins are arranged between and below its two floats, which expedites docking operations since they do not constitute prominent members with respect to the overall geometry of the boat. These fins have moreover been designed to be laterally split into two halves in order not only to allow the boat to be controlled during dynamic diving and rising but further to serve as members controlling rolling and pitching.

Other characteristics of the invention lie in the boat's propulsion system, cooling system, ballast system, emergency and service pneumatic system and steering system as detailed hereinafter and in accordance with the contents of the attached set of claims.

DESCRIPTION OF THE DRAWINGS

In order to provide a fuller description and contribute to the complete understanding of the characteristics of this invention, a set of drawings is attached to the specification which, while purely illustrative and not fully comprehensive, shows the following.

The layout and characteristics of the various systems and components of the submersible boat can be varied in accordance with the technological developments fitted thereon, for this does not encumber the basic notion of the invention and the claims set forth in this patent.

DETAILED DESCRIPTION OF THE PREFERRED EMBODIMENT OF THE INVENTION

Figure 1:
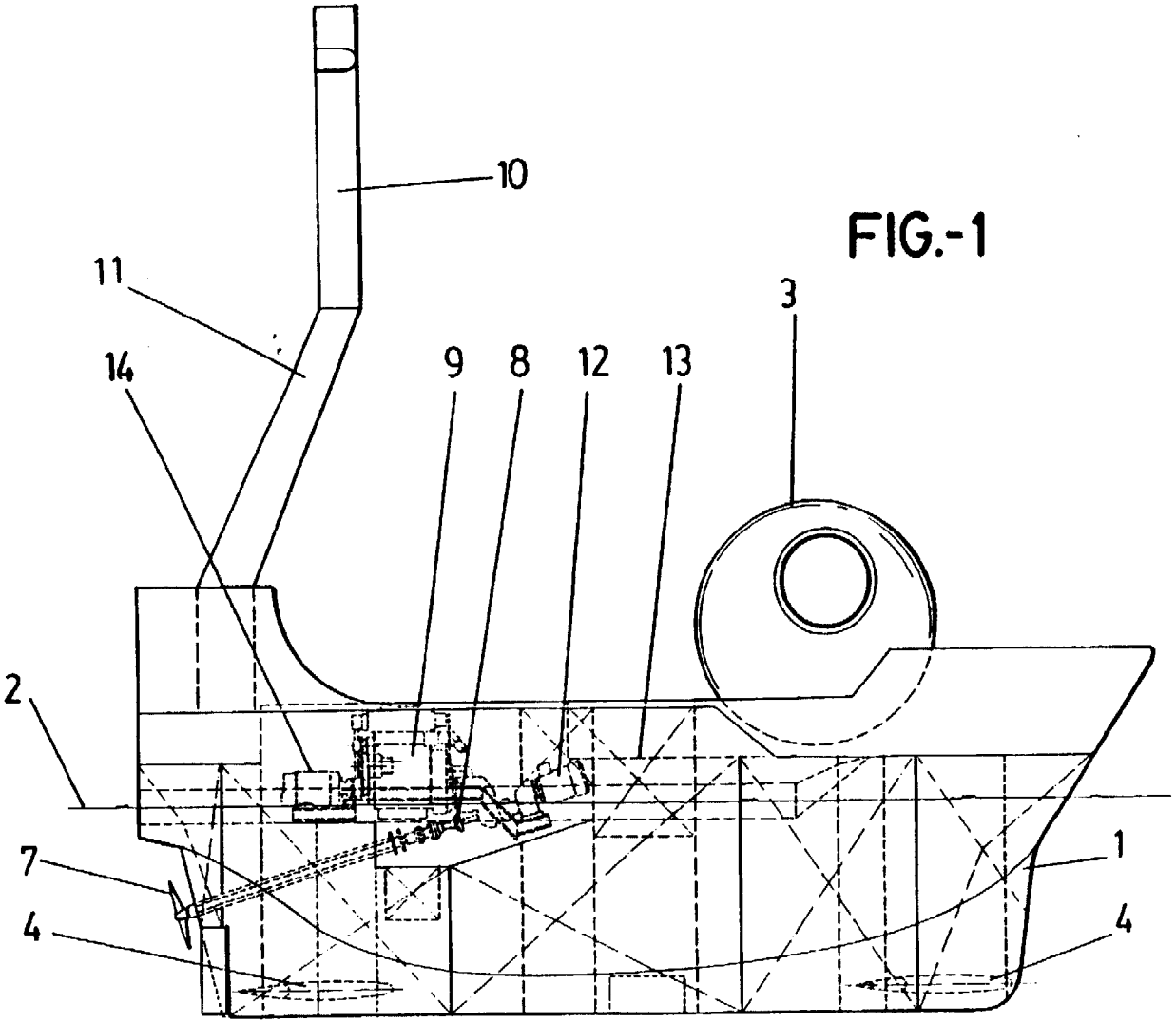
FIG. 1. is a schematic side elevation view of a submersible boat constructed in accordance with the present invention.
Figure 2:
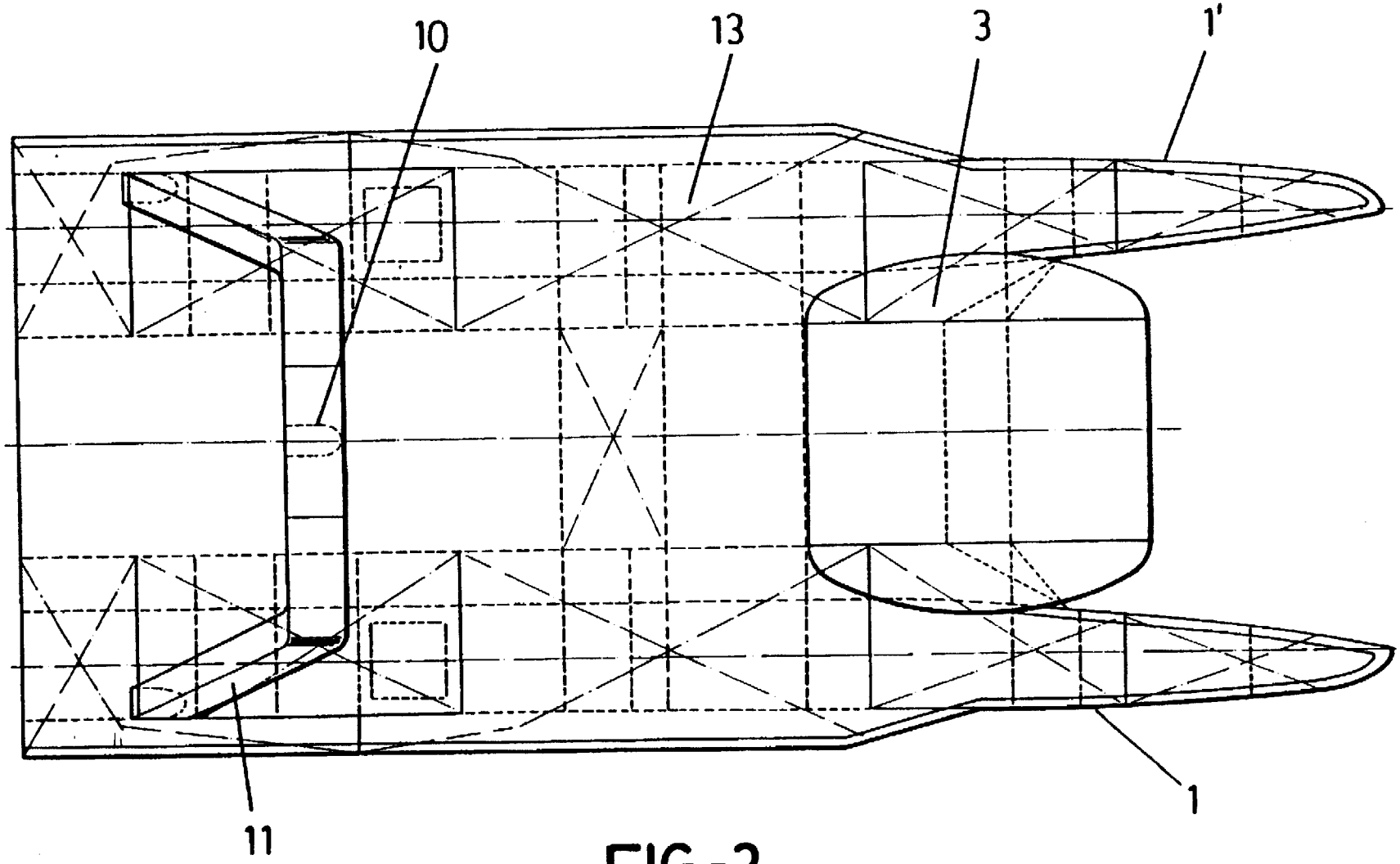
FIG. 2. is a plan view thereof.
Figure 3:
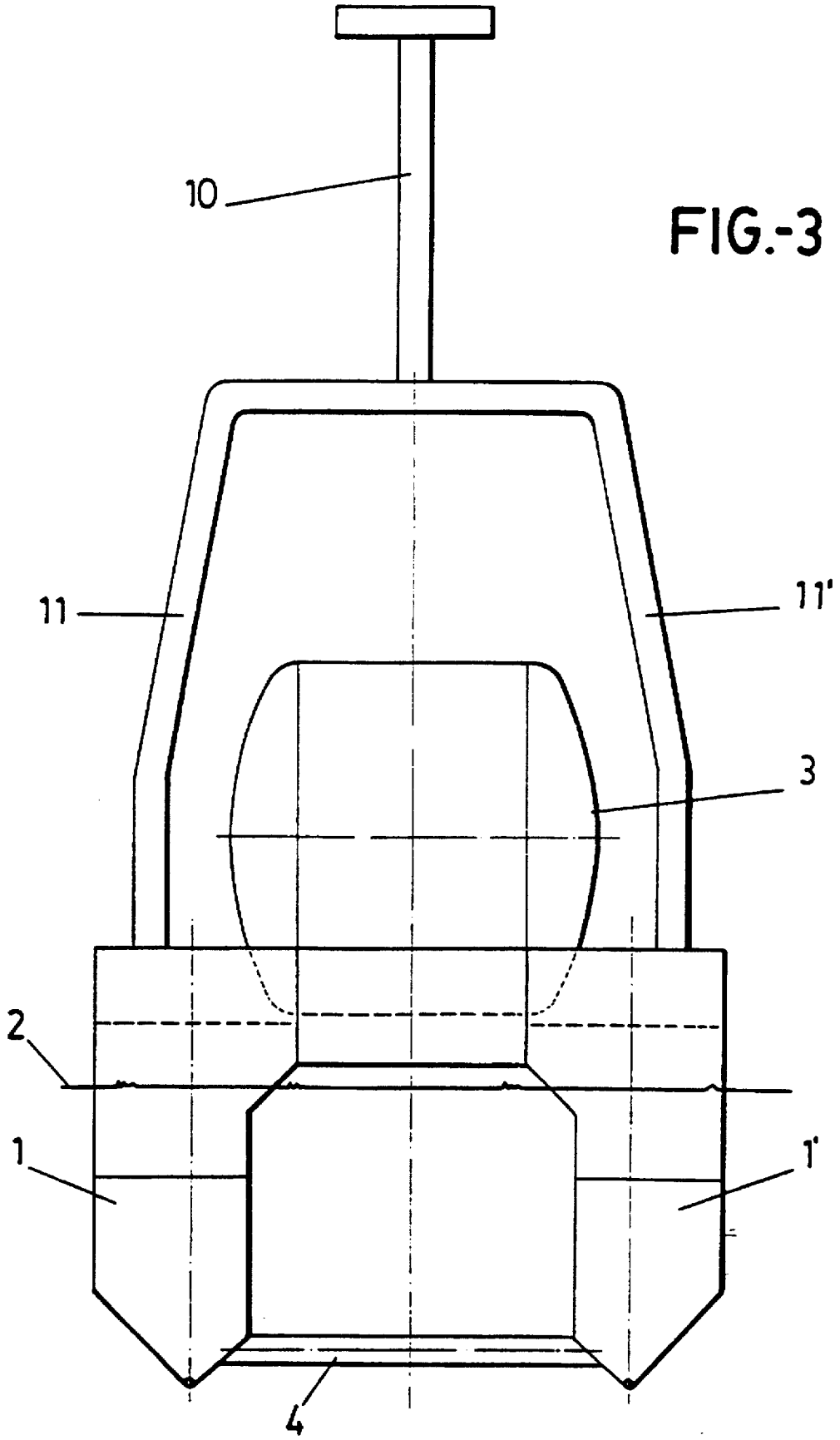
FIG. 3. is a front elevation view thereof.

With reference to the figures, the submersible boat disclosed herein is shown to have a general catamaran type structure comprising two side floats (1–1') which are maintained partially under the water-line (2) of the boat, a cabin for occupants (3), whose shape may be substantially cylindrical as shown in FIGS. 1 to 3 or otherwise, mounted on the floats (1), the cabin (3) being kept totally above the water-line (2) when the boat navigates on the water and obviously being submerged when the boat navigates underwater.

Figure 4:
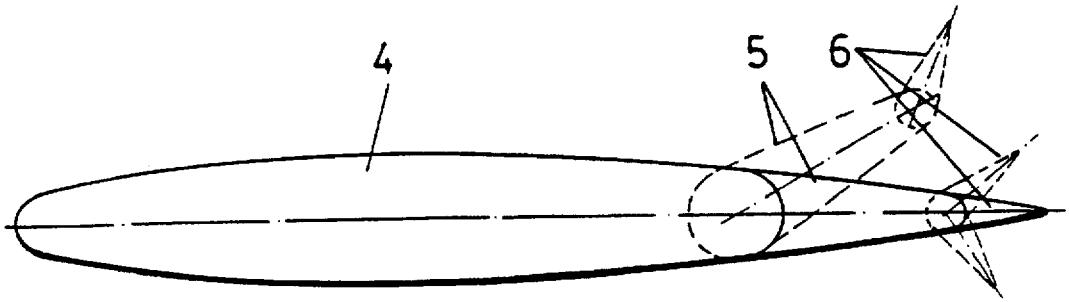
FIG. 4. is an enlarged profile detail of one of the fins.

Diving takes place dynamically, with the assistance of fins (4) which are shown, in particular in FIG. 1, to lie between and below the floats (1–1'). The fins (4), whose structure is shown in detail in FIGS. 4 and 5, having a hydrodynamic profile, are split lengthwise into three sectors, a horizontal fixed sector (4) and two articulated sectors (5) and (6) which may be moved both upwards and downwards, as shown in FIG. 4, to achieve a diving or raising effect, in other words whichever is desired from time to time and at all events based upon the relative displacement between such fins (4) and the water.

Figure 5:
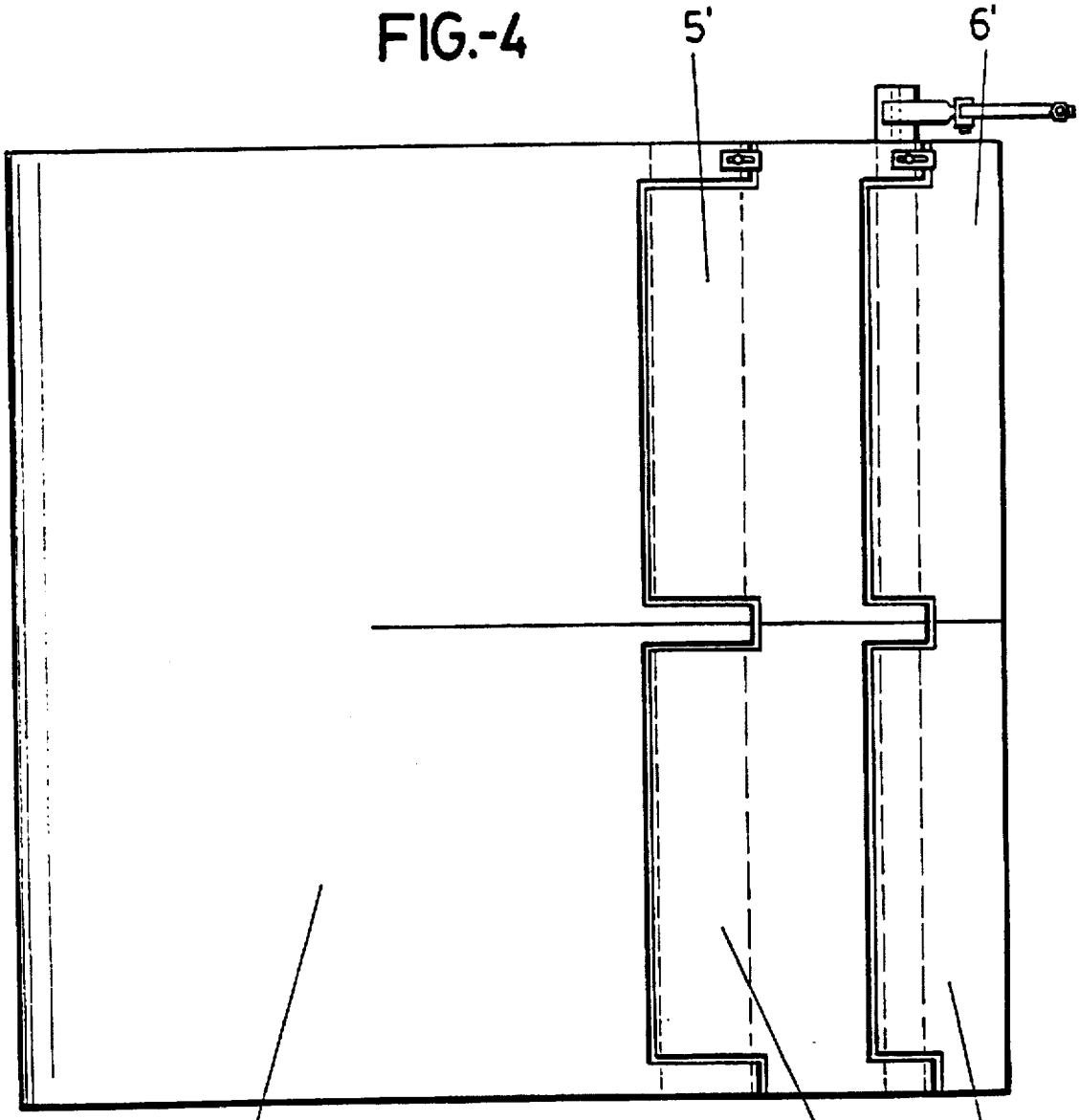
FIG. 5. is a plan view of the fin of FIG. 4 figure.
Figure 6:
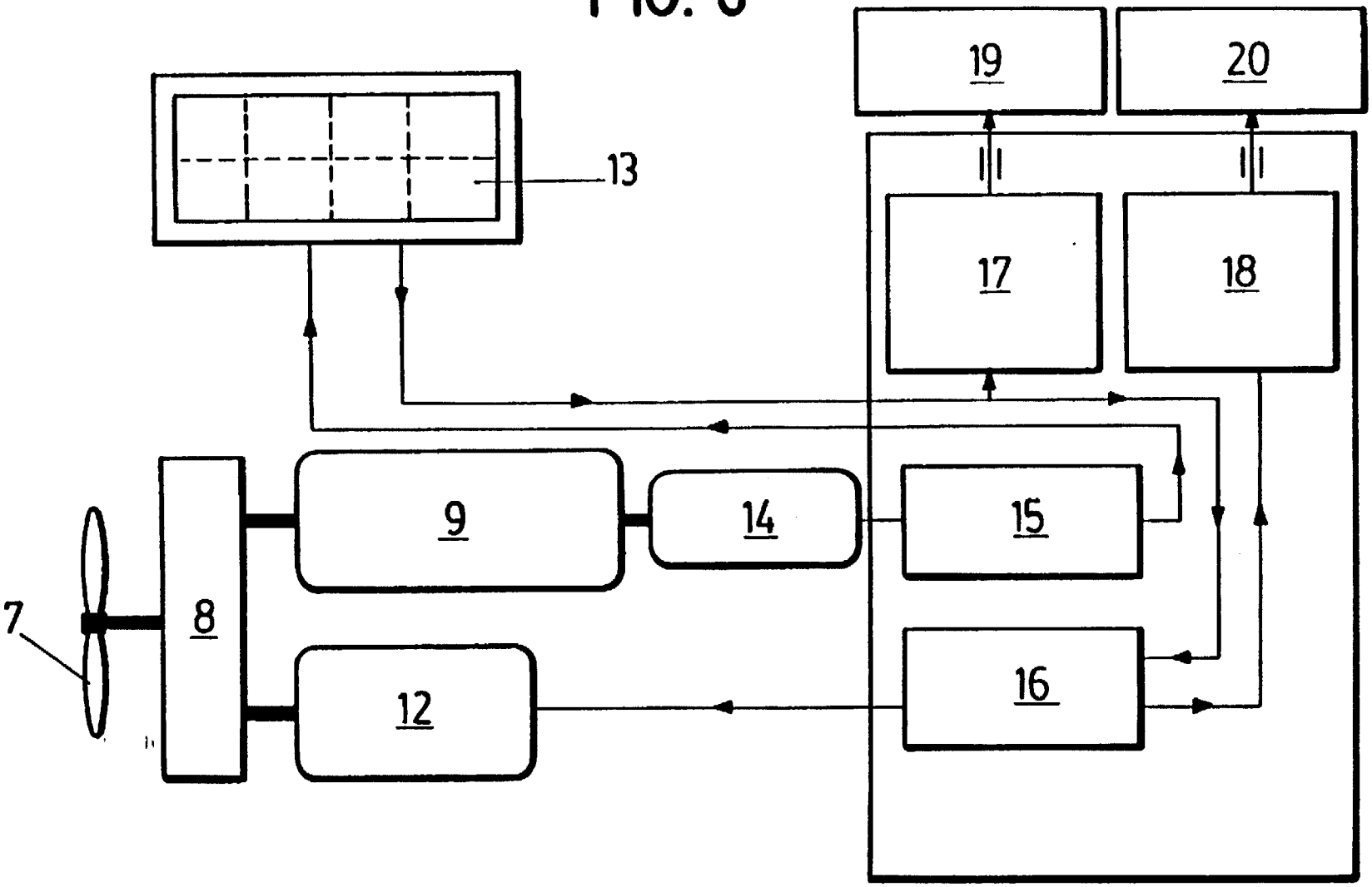
FIG. 6. is a diagrammatic illustration of the propulsion unit.

Furthermore, and as shown in FIG. 5, the rear and articulated sector (5–6) of each fin (4) is laterally split into two halves (5–5') and (6–6') thereby for an asymmetry on the pivoting side of such fins or between the bow and stern fins to produce a compensating effect for the boat's balancing and pitching movements.

The boat is propelled by two propellers (7) arranged at the rear end of its floats (1–1'), the propellers receiving the drive of a diesel engine (9) through a gearing (8) when navigating on the water or submerged at shallow depth, less than 2 or 3 meters, the snorkel or funnel (10) being used as a means for drawing air in and letting off gases to and from each diesel engine (9), the funnel (10) being of forked shape thereby with its output branch (10) having two input branches (11–11') associated leading from the respective diesel engines (9), as in the patent above-mentioned, whereas when the boat is submerged beyond the aforesaid shallow depth the diesel engines (9) are stopped and replaced by respective electric motors (12) driven from a set of batteries (13) which are previously charged by the diesel engine (9) through an alternator (14) fitted with a rectifier (15) and a frequency regulator (16), thereby for the various components of the boat consuming direct current (19) and alternating current (20), referred to hereinafter, to be supplied by two switchboards (17) and (18), respectively providing direct and alternating current. The batteries may also be charged using external power supplies.

Figure 7:
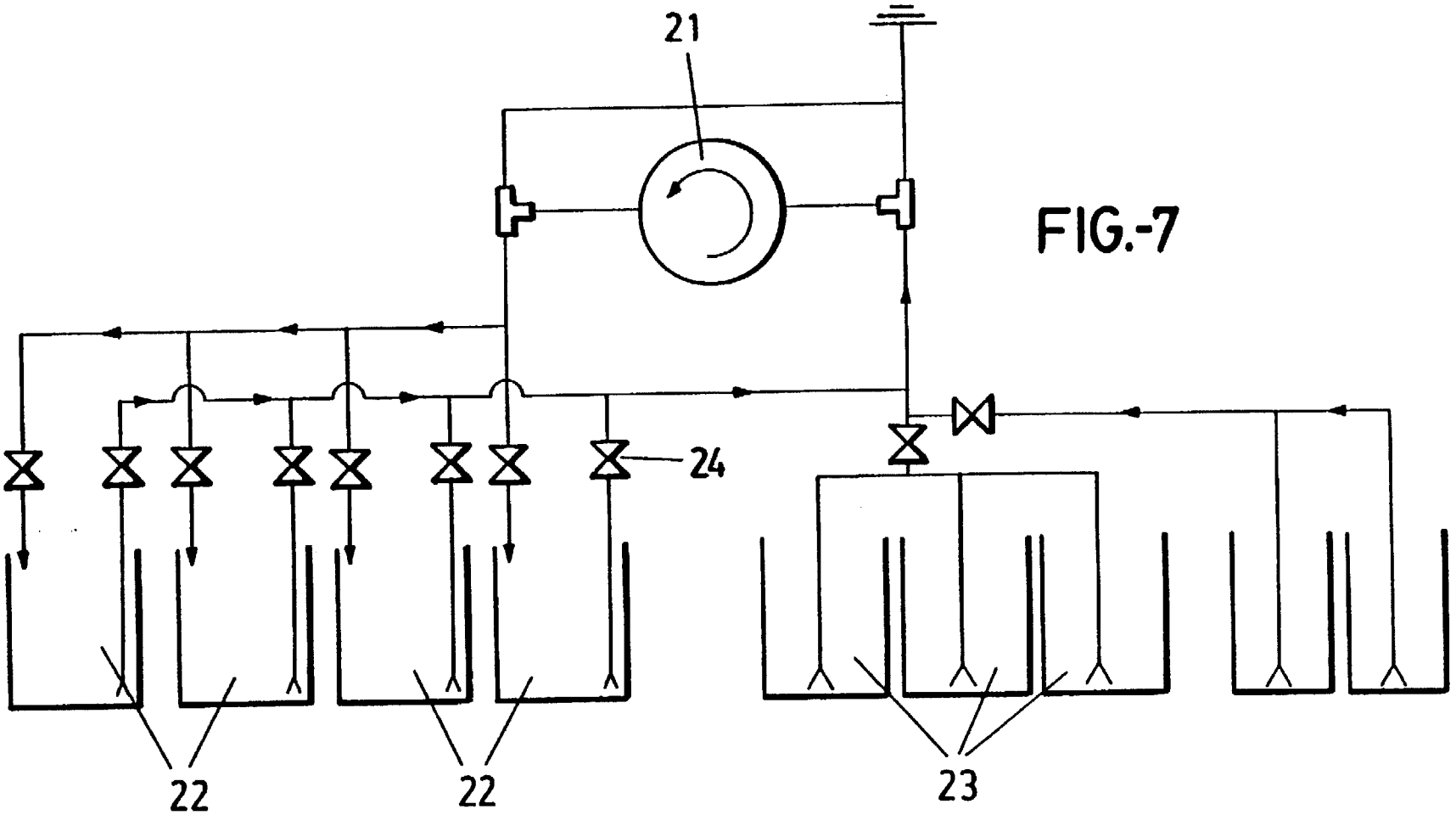
FIG. 7. is a diagrammatic illustration of the ballast system.

As noted hereinabove, diving is expedited by a ballast system schematically shown in FIG. 7, which comprises a self-drawing seawater centrifugal electropump (21) which supplies and removes water to and from a number of balance tanks (22) and ballast tanks (23) through a number of pneumatically actuated valves (24).

Figure 8:
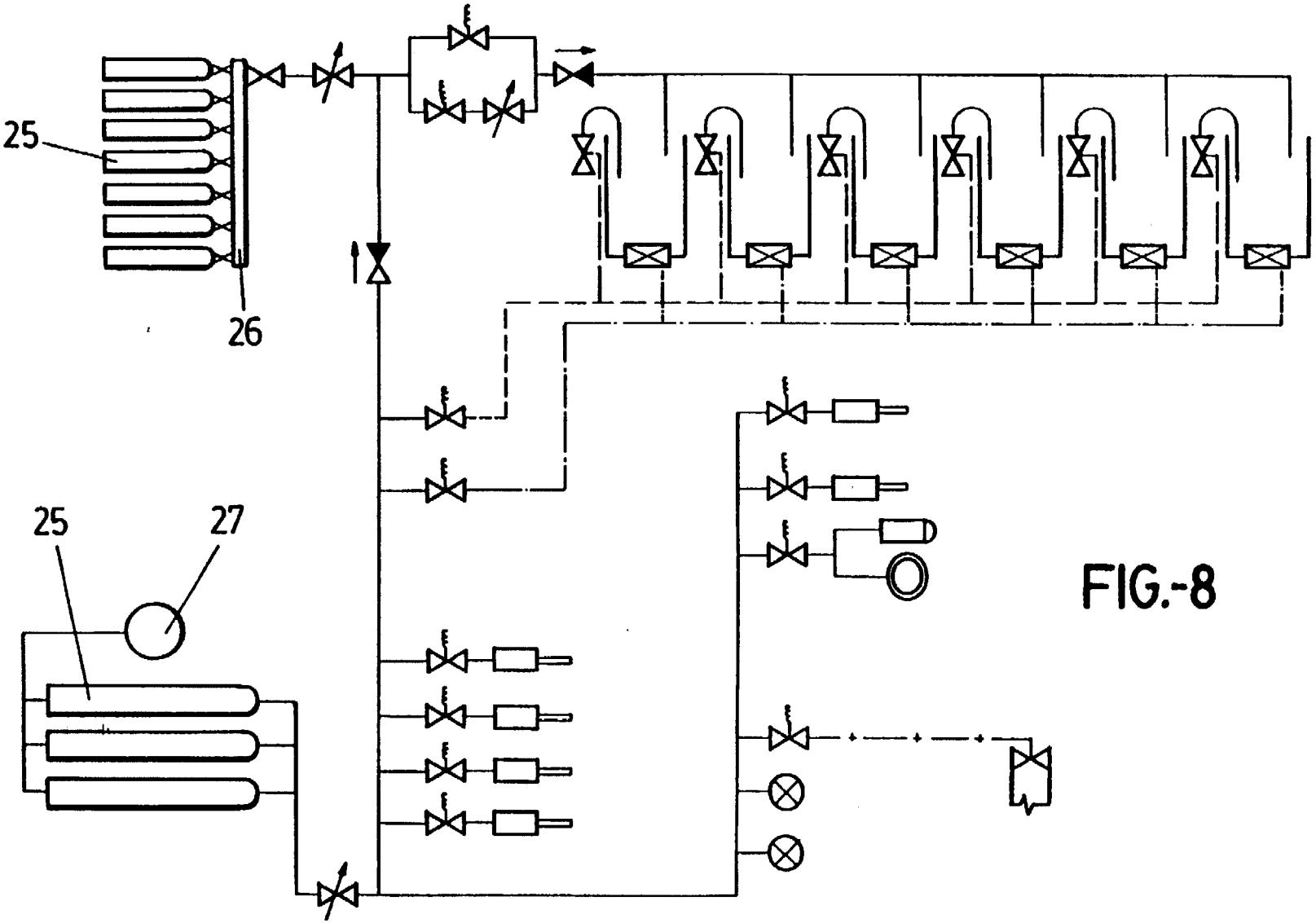
FIG. 8. is a diagrammatic illustration of the emergency and service pneumatic system.

FIG. 8 shows the emergency pneumatic and service system comprising a plurality of air cylinders (25), which are mounted upon respective stands (26), are fitted with pressure regulating means and are fed through a compressor head (27) coupled to one of the engines (9), and feed and supply air to atmospheric valves, bottom valves and pressure compensating valves, cylinders actuating the rudders, the fins, the valves shutting off the snorkel tubes (10) and (11), the diesel engine accelerator cylinders, the engine gear cylinders and the electrovalves controlling the foregoing elements, as shown schematically in FIG. 8.

Figure 9:
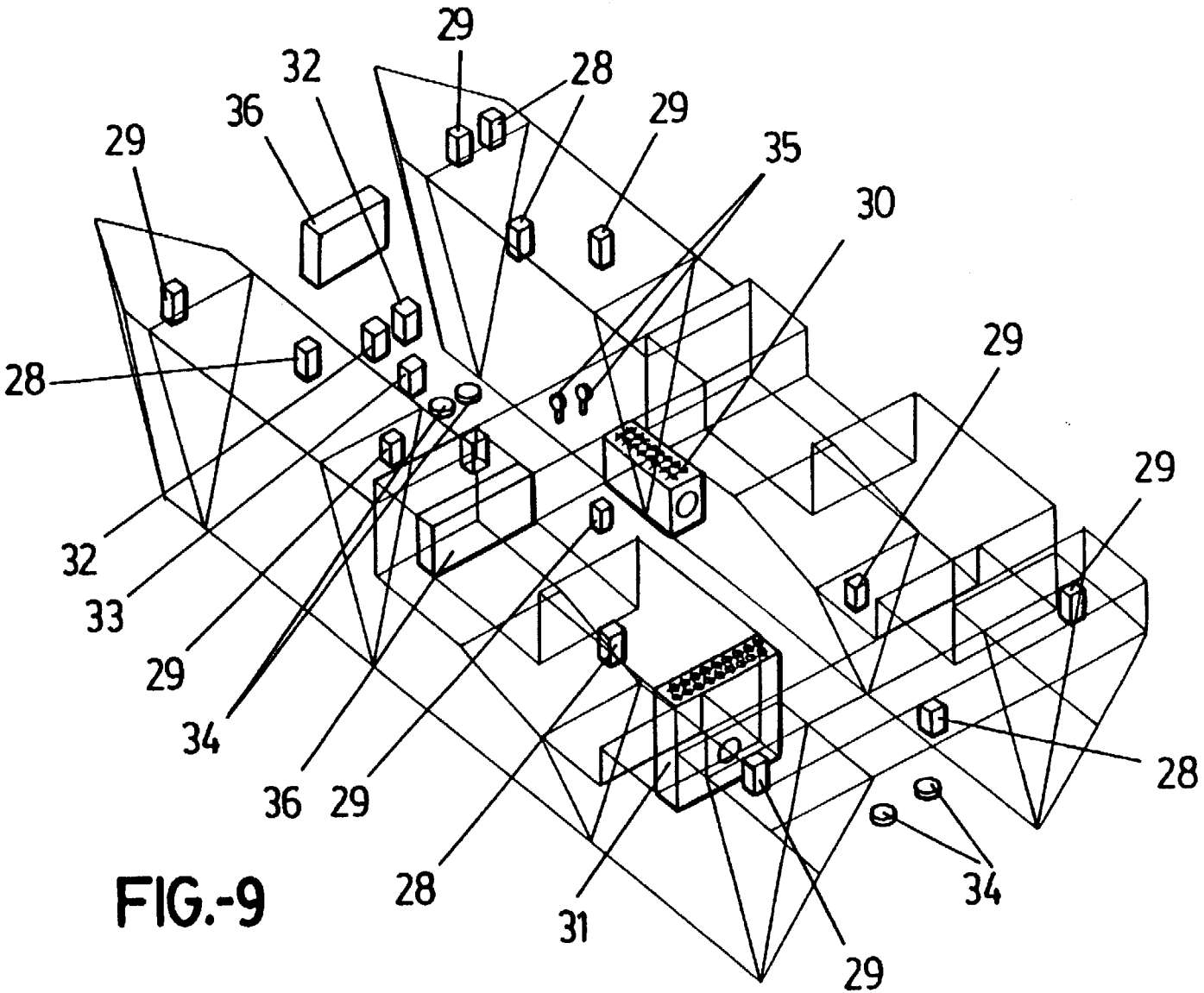
FIG. 9. is a schematic perspective view of the boat's floats where the various members of the control system have been schematically distributed.
Figure 10:
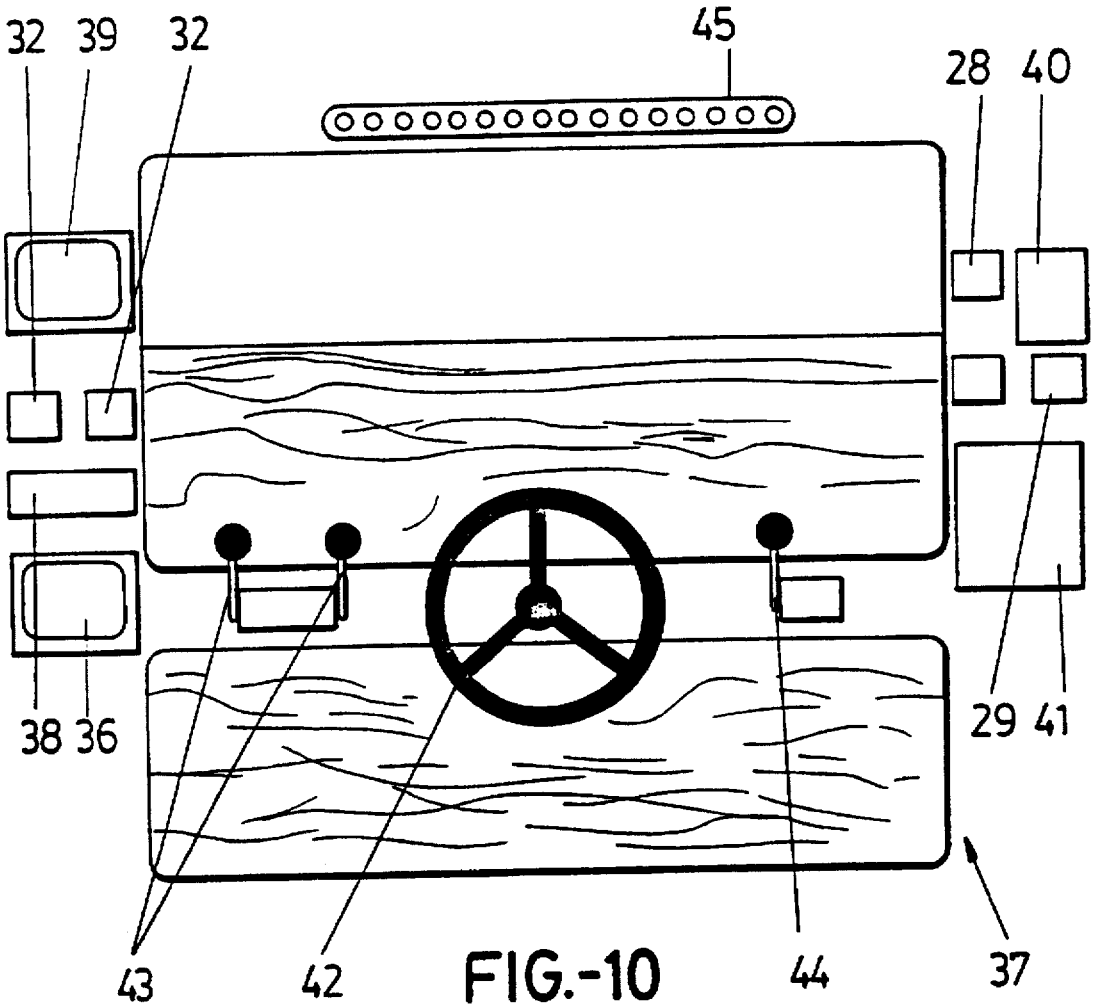
FIG. 10. is a schematic front elevation view of the control board from which the boat is steered.

As shown schematically in FIG. 9, the control system includes pressure sensors (28), depth sensors (29), said ballast system electrovalves (30), pneumatic system electrovalves (31), cabin gas analyzers (32), a cabin temperature and relative humidity sensor (33), fin load cells (34), inclinometers (35) and computers (36), the latter being situated in the cabin, specifically on the control board (37) shown in FIG. 10, moreover fitted with a radio communication system (38), a video circuit (39), a satellite position system (40), a sounder (41), a steering-wheel (42) and the necessary boat speed and steering and depth levers (43) and (44). An alarm unit (45) automatically signals any anomaly.

From a functional viewpoint, the boat control system is responsible for the operation of the various systems and continuously receives data from all the sensors fitted aboard the boat, sending out commands to all actuators.

The control system is programmed such that the boat operator needs no controls other than as mentioned hereinabove, in other words the steering-wheel or helm (42), a depth lever (44), a speed lever (43) and a switch to select the desired navigation status, although the operator may operate others that are not as essential.

Figure 11:
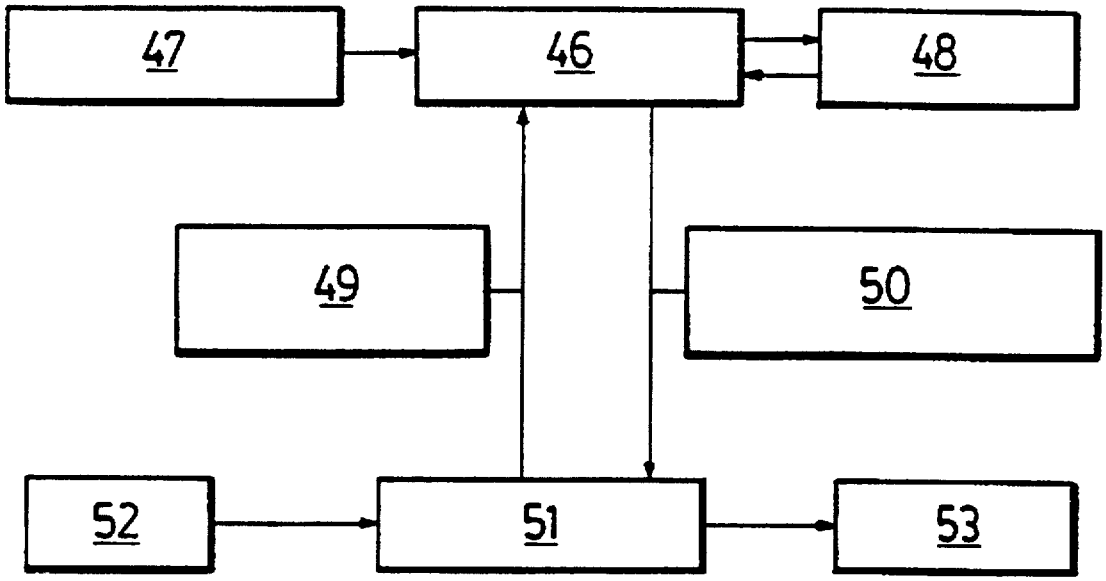
FIG. 11. is lastly a block diagram of the system for controlling the boat.

The general diagram of the control system of FIG. 11 clearly shows system operation, the references numerals therein representing for the following items:

46 Master cabin computer.

47 Cabin sensor data.

48 Operator interface.

49 Current sensor and actuator values.

50 Actuator reference values.

51 Engineroom slave computer.

52 Sensor data.

53 Actuator commands.

The control system therefore comprises a slave computer (51) located at the engine room and designed to receive data (52) from the sensors and send appropriate commands (53) to actuators, and the master computer (46) responsible for making control calculations, sending the slave computer (51) actuating commands and supporting the boat operator communication interface (48).

The main characteristics of this system primarily lie in the following:

Physical components (hardware) comprising standard compatible commercial cards.

Structured programming.

Easy maintenance and inspection, including the boat's operating statistic record.

Highly reliable hardware and software.

The structure disclosed is additionally fitted with an emergency system based upon the principle of intrinsic safety by maintaining a compensated positive buoyancy in normal navigation and by reverse dynamic lift at the fins (4), provision being made for the tanks to have emergency unballasting, the possibility of detaching the cabin, the possibility of lifting the vehicle through eyebolts, the possibility of pressurizing the cabin to open the door and exit, and lastly radio communication with the outside through a communications buoy or through underwater communications systems.

The materials, shape, size and layout of the elements may be altered provided that this entails no modification of the essential features of the invention.

The terms used to describe the invention herein should be taken to have a broad rather than a restrictive meaning.

What is claimed is:

1. A submersible boat comprising:

a hull including two side floats in catamaran arrangement, a cabin supported between and above said floats, two fins for controlling diving and steering of the boat, said fins extending crosswise between said floats and being submerged when said boat is on the surface of the water, said fins including pivotal sectors which are movable between upwardly and downwardly tilted positions, ballast and balance tanks supported by said hull for receiving and removing water, the boat normally having positive buoyancy, a drive propeller, a diesel engine, an electric motor, means for drivingly connecting said diesel engine to said propellers to drive said boat on the surface of the water and at shallow depths and for drivingly connecting said electric motor to said propeller to drive said boat at depths greater than said shallow depth, said fins having a first position to cause said boat to dive when propelled by said engine or said motor while the boat has positive buoyancy and a second position to cause said boat to rise under the positive buoyancy thereof, said boat being maintained at a submerged depth at a stationary position by halting the propeller and introducing water into the ballast and balance tanks to provide neutral buoyancy for the boat.

2. A submersible boat as in claim 1, wherein each side float has an aft end with a respective said propeller thereat.

3. A submersible boat as in claim 1, wherein one of said fins is at a forward end of said floats and the other of said fins is at an aft end of said floats.

4. A submersible boat as in claim 1, wherein said cabin is mounted forwardly on said floats and is raised above the water level when the boat is on the surface of the water.

5. A submersible boat as in claim 1, wherein said ballast and balance tanks are located at both sides of the boat at the bow and stern thereof.

6. A submersible boat as in claim 1, wherein the hulls have compartments or chambers which fully or partially balance its internal pressure with respect to the external pressure acting on the hull at any underwater depth at which the very boat is submerged, both when stopped underwater and submerged dynamically.

7. A submersible boat as in claim 1, wherein underwater displacement which is at least 80% greater than its surface displacement and at least a 45% positive buoyancy when navigating on the surface as a conventional boat, or when stopped on said surface.

8. A submersible boat as in claim 1, wherein the cabin is detachable from the rest of the boat, and includes an element with its own buoyancy, the lowest point of said cabin lying above the water-line.

9. A submersible boat as in claim 1, wherein the boat has two distinct zones for occupants to be located including said cabin used during both diving and surface navigation, and an open deck used during surface navigation, both zones having respective sets of navigation controls.

10. A submersible boat as in claim 1, wherein each fin, has a generally aerodynamic profile, and includes a front major sector whose rear edge is articulately fitted with two other rear, articulated sectors constituting deflecting means for diving or raising the boat, the rear articulated sectors on each said fin being laterally split into two equal separately actuated halves, to provide asymmetric position of the two halves to serve as a system for controlling rolling and pitching movements of the boat.

11. A submersible boat as in claim 1, wherein said diesel engine includes a funnel leading into the atmosphere, which draws air and lets off gases to and from the diesel engine, said diesel engine being connected to an alternator that charges a set of batteries which power the electric motor through a circuit including a rectifier, and a double switchboard supplying direct and alternating current to various apparatus and instruments on the boat.

12. A submersible boat as in claim 1, further comprising 8, characterized because the boat includes one or several a self-drawing centrifugal an electropump for pumping seawater to and from said ballast and balance tanks and pneumatically actuated valves controlling connection of said electropump to said tanks.

13. A submersible boat as in claim 1, which further includes an emergency and service pneumatic system comprising a plurality of air cylinders mounted on respective stands which are assisted by a filling compressor actuated by the diesel engine, thereby for the compressed air within such cylinders to be used through suitable valves to actuate the cylinders of rudders and said fins, a shut-off valve of a funnel of the diesel engine and engine accelerator cylinders, all from a control board located in the cabin through a control system central computer.

14. A submersible boat as in claim 1, comprising a boat control system which includes pressure sensors, depth sensors, ballast system electrovalves, pneumatic-system electrovalves, cabin gas analyzers, cabin temperature and relative humidity sensors, fin load cells, inclinometers and computers, signal means on a control board where a boat steering-wheel, boat speed and depth regulation levers and navigation accessories are located including, radio systems, video systems, a satellite position system and a sounder.

* * * * *